US010014610B2

(12) United States Patent
Kurita et al.

(10) Patent No.: US 10,014,610 B2
(45) Date of Patent: Jul. 3, 2018

(54) CONDUCTIVE CONTACT INCLUDING AN ELASTIC CONTACT PIECE WITH PROTRUDING PORTIONS

(71) Applicant: Kitagawa Industries Co., Ltd., Inazawa-shi, Aichi (JP)

(72) Inventors: Tomohisa Kurita, Kasugai (JP); Hideo Yumi, Kasugai (JP)

(73) Assignee: KITAGAWA INDUSTRIES, CO., LTD., Inazaws-Shi, Aichi (JP)

( * ) Notice: Subject to any disclaimer, the term of this patent is extended or adjusted under 35 U.S.C. 154(b) by 0 days.

(21) Appl. No.: 15/471,997

(22) Filed: Mar. 28, 2017

(65) Prior Publication Data

US 2017/0288329 A1 Oct. 5, 2017

(30) Foreign Application Priority Data

Mar. 30, 2016 (JP) ..... 2016-069013

(51) Int. Cl.
*H01R 12/00* (2006.01)
*H01R 12/71* (2011.01)
(Continued)

(52) U.S. Cl.
CPC ..... *H01R 12/718* (2013.01); *H01R 4/02* (2013.01); *H01R 13/245* (2013.01)

(58) Field of Classification Search
CPC . H01R 4/02; H01R 9/24; H01R 9/091; H01R 9/096; H01R 12/00; H01R 12/718;
(Continued)

(56) References Cited

U.S. PATENT DOCUMENTS

2010/0068901 A1* 3/2010 Yumi ..... H01R 13/03 439/78
2012/0217050 A1* 8/2012 Kurita ..... H01R 12/57 174/261

(Continued)

FOREIGN PATENT DOCUMENTS

JP 2000150035 A 5/2000
JP 2010161010 A 7/2010

OTHER PUBLICATIONS

European Patent Office, "Extended European Search Report", App. No. 17163744.0, dated Jun. 9, 2017, 8 pages.

*Primary Examiner* — Chandrika Prasad
(74) *Attorney, Agent, or Firm* — Schwabe Williamson & Wyatt

(57) ABSTRACT

A contact in one aspect of the present disclosure comprises a fixing portion, an elastic contact piece, and a pair of projecting tabs, which are formed as an integrated entity from a metal thin plate. The projecting tabs project from the fixing portion at positions on both sides of the elastic contact piece. A dimension of the elastic contact piece in a width direction, which matches the direction of an interval between the projecting tabs, is a first dimension. The projecting tabs are formed such that each projecting tab is a flat plate having the same thickness as the thin plate. The projecting tabs are arranged such that the thickness directions thereof are the same direction, in locations that have inner surfaces of the projecting tabs facing each other, and an interval between the inner surfaces is a second dimension greater than the first dimension.

8 Claims, 9 Drawing Sheets

(51) Int. Cl.
*H01R 4/02* (2006.01)
*H01R 13/24* (2006.01)

(58) Field of Classification Search
CPC ..... H01R 12/52; H01R 12/526; H01R 12/65; H01R 12/707; H01R 13/245; H01R 13/2435
USPC ..... 439/81, 83, 84, 884, 65, 66
See application file for complete search history.

(56) References Cited

U.S. PATENT DOCUMENTS

2015/0222035 A1* 8/2015 Kurita ..... H05K 9/0016 439/876
2016/0126652 A1* 5/2016 Kurita ..... H01R 13/02 439/884
2016/0126653 A1* 5/2016 Kurita ..... H01R 13/15 439/884

* cited by examiner

LEFT ⟷ RIGHT
UP ⟷ DOWN
1
21
5
35
23A
23
37
7
11A
11B
11
25
25A
3
13
15
31
33

FRONT ⟷ BACK
IVB
W3
W2
W1
UP ⟷ DOWN
1
35
7
3
13
11
25
15
31
33
23A
37
21
23
5
25A
11A
11B

LEFT ⟷ RIGHT
UP ⟷ DOWN
1
21
5
38
11A
11B
3
13
31
15
11
25A
23A
23
39
7
25
33

FRONT ⟷ BACK
VB
VB
UP ⟷ DOWN
38
39
1
3
13
31
7
11
25
15
23A
21
23
5
25A
11A
11B
33

FRONT
BACK
UP
DOWN
55
57
53A
53
51
3
13
31
11
25
15
37
23A
21
23
5
25A
11A
11B
33

FRONT
BACK
UP
DOWN
40
41
7
41A
1
3
13
31
11
25
15
23A
21
23
5
25A
11A
11B
33

CONDUCTIVE CONTACT INCLUDING AN ELASTIC CONTACT PIECE WITH PROTRUDING PORTIONS

CROSS-REFERENCE TO RELATED APPLICATIONS

THIS APPLICATION CLAIMS THE BENEFIT OF JAPANESE PATENT APPLICATION NO. 2016-069013 FILED ON Mar. 30, 2016 WITH THE JAPAN PATENT OFFICE, THE ENTIRE DISCLOSURE OF WHICH IS INCORPORATED HEREIN BY REFERENCE.

BACKGROUND

The present disclosure relates to a contact.

A contact that electrically connects a conductor pattern in an electronic circuit board to another conductive member (a housing of an electronic device, for example) is known as a component used for grounding in an electronic circuit board, as disclosed in Japanese Unexamined Patent Application Publication No. 2000-150035A (hereinafter referred to as '035 Publication), for example. This type of contact is soldered to the stated conductor pattern so as to make contact with the stated conductive member, and as a result, the conductor pattern and the conductive member are electrically connected.

With the contact disclosed in '035 Publication, a leg portion (12) is constituted by a curved portion (12*a*), a vertical portion (12*b*), and an end portion (12*c*) in that order from a base portion (11). The curved portion (12*a*) initially curves upward from the base portion (11), then curves in a U shape and connects to the vertical portion (12*b*).

SUMMARY

With the contact disclosed in '035 Publication, the curved portion (12*a*) is provided as described above, and thus a width between outer surfaces of the leg portions (12), which are provided as a pair, is relatively greater than a width of a contact portion (13). There is thus a problem in that providing the pair of leg portions (12) having secured a sufficient width for the contact portion (13) will increase the overall width of the contact. Alternatively, the overall width of the contact may be taken as a reference and that width may then be narrowed to a desired dimension. However, doing so makes the width of the contact portion (13) relatively narrow, which may cause problems such as a drop in the spring properties of the contact position (13).

It is desirable in one aspect of the present disclosure to provide a contact having good spring properties in a moving part while at the same time ensuring a compact size for a feed part that is fixed to as electronic circuit board.

One aspect of the present disclosure is a contact that, by being soldered to a conductive pattern in an electronic circuit board so as to make contact with a conductive member separate from the electronic circuit board, electrically connects or couples the conductive pattern to the conductive member. The contact comprises: a fixing portion configured to be fixed to the electronic circuit board by the soldering; an elastic contact piece extending from the fixing portion, the elastic contact piece being configured to be capable of swinging relative to the fixing portion by elastically deforming, and the elastic contact piece being further configured to contact the conductive member and elastically deform so as to be pressed by the conductive member when the conductive member is arranged in a position opposite from the electronic circuit board; and a pair of projecting tabs projecting from the fixing portion at positions on both sides of the elastic contact piece. The fixing portion, the elastic contact piece, and the pair of projecting tabs are formed as an integrated entity from a metal thin plate. A dimension of the elastic contact piece in a width direction, the width direction matching a direction of an interval between the projecting tabs, is a first dimension, and the elastic contact piece is configured to be capable of swinging in a direction orthogonal to the width direction. Each projecting tab is configured as a flat plate having the same thickness as the thin plate, and the projecting tabs are arranged such that thickness directions of the projecting tabs are the same direction and inner surfaces of the projecting tabs face each other, with an interval between the inner surfaces being a second dimension greater than the first dimension.

According to the contact configured as described above, the conductor pattern of the electronic circuit board can be electrically connected or coupled to the conductive member, which is separate from the electronic circuit board. The above-described projecting tabs are formed such that each projecting tab is a flat plate having the same thickness as the thin plate, and the projecting tabs are arranged such that the thickness directions thereof are the same direction, in locations that have inner surfaces of the projecting tabs facing each other. Thus the projecting tabs only have a thickness corresponding to the thickness of the thin plate with respect to the direction of the interval between the projecting tabs, and a region occupied by the pair of projecting tabs can thus be made compact with respect to the direction of the interval described above. Accordingly, the overall structure of the contact can be made more compact, improving the ability to incorporate the contact into small devices, than in a case where projecting portions that are thicker than the above-described thin plate are provided.

Furthermore, because the pair of projecting portions is provided as described above, when another member disposed near the contact has moved toward the elastic contact piece, the other member can be brought into contact with the projecting tabs. This restricts the other member from moving any further. A situation in which the other member makes contact with the elastic contact piece can be suppressed, and thus a situation in which the elastic contact piece bends due to contact with the other member can be suppressed. The elastic contact piece can therefore function as designed, which makes it possible to connect or couple the conductor pattern and the conductive member correctly.

For example, the configuration is such that when using positioning tabs projecting from the conductive member side to position the positioning tabs and the contact with respect to each other, the positioning is carried out using the positioning tabs and the pair of projecting tabs. This makes it possible to ensure that the positioning tabs make contact with the pair of projecting tabs but do not make contact with the elastic contact piece. Thus, unlike a contact in which the above-described pair of projecting tabs is not provided, a situation in which the elastic contact piece bends due to the contact between the positioning tabs and the elastic contact piece can be suppressed, and the elastic contact piece can therefore function as designed.

DETAILED DESCRIPTION OF THE PREFERRED EMBODIMENTS

Figure 1A:
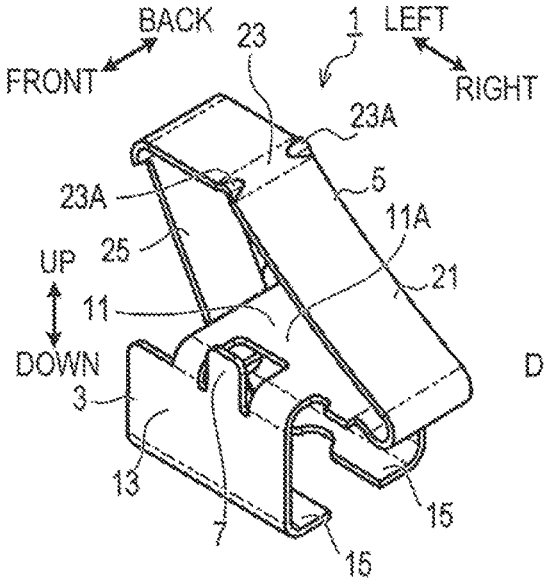
FIG. 1A is a perspective view of a contact according to a first embodiment, taken from the right upper-front.
Figure 1B:
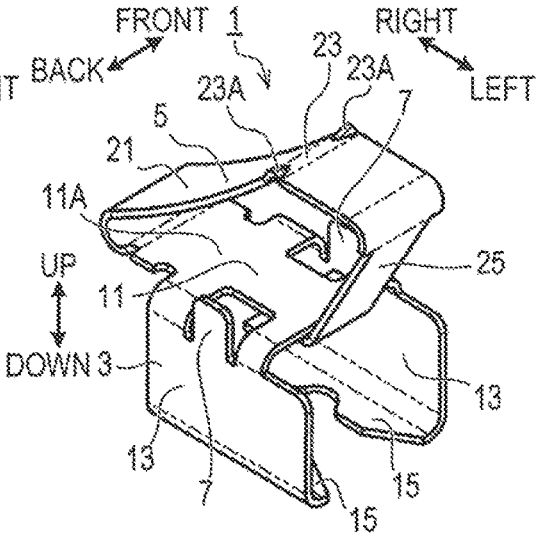
FIG. 1B is a perspective view of the contact according to the first embodiment, taken from the left upper-rear.
Figure 1C:
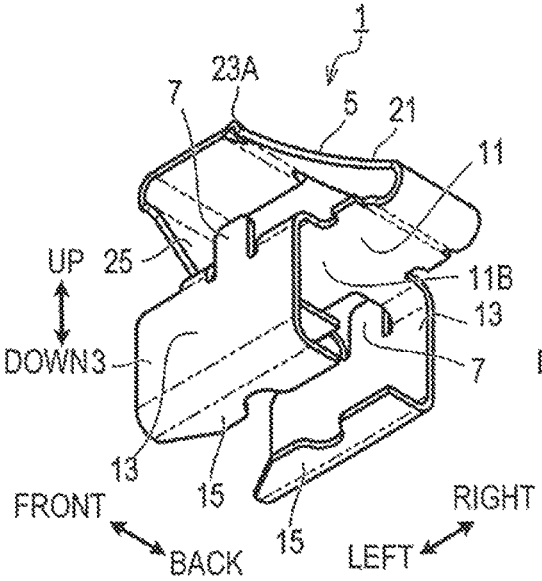
FIG. 1C is a perspective view of the contact according to the first embodiment, taken from the right lower-front.
Figure 1D:
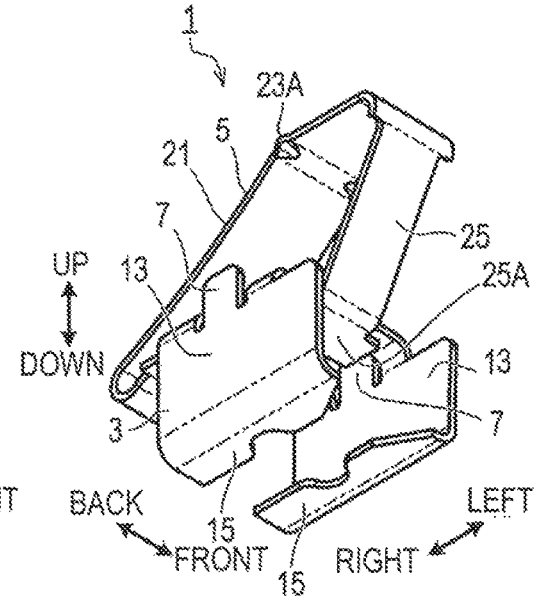
FIG. 1D is a perspective view of the contact according to the first embodiment, taken front the left lower-rear.
Figure 2A:
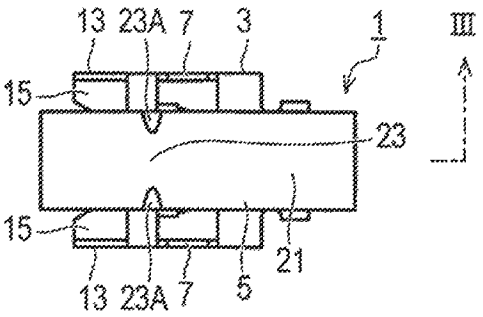
FIG. 2A is a plan view of the contact according to the first embodiment.
Figure 2C:
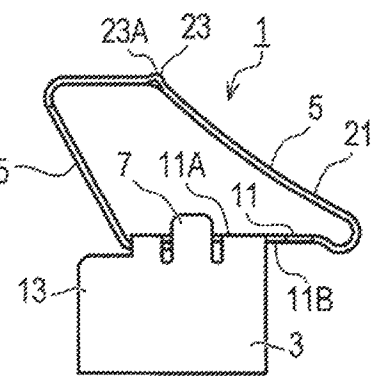
FIG. 2C is a front view of the contact according to the first embodiment.
Figure 2E:
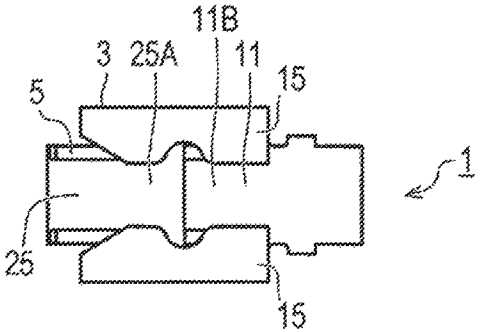
FIG. 2E is a bottom view of the contact according to the first embodiment.
Figure 2D:
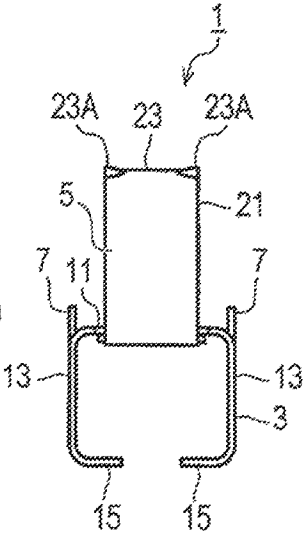
FIG. 2D is a right side view of the contact according to the first embodiment.
Figure 2B:
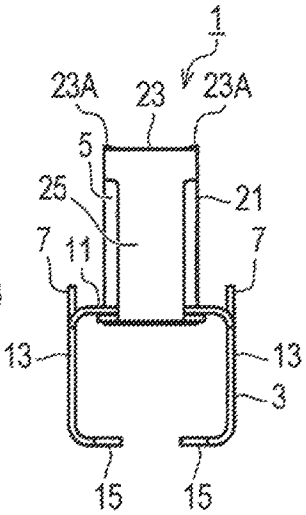
FIG. 2B is a left side view of the contact according to the first embodiment.

Example embodiments of the present disclosure will be described below.

(1) First Embodiment

Contact Configuration

As illustrated in FIGS. 1A, 1B, 1C, and 1D, a contact 1 comprises a fixing portion 3, an elastic contact piece 5, and a pair of projecting tabs 7 and 7. The fixing portion 3, the elastic contact piece 5, and the pair of projecting tabs 7 and 7 are formed as an integrated entity by press-machining a metal (beryllium, copper, in the present embodiment) this plate (0.1 mm thick, in the present embodiment). In the present embodiment, the contact 1 is formed with plane symmetry, with a plane perpendicular to a front-back direction serving as the plane of symmetry, as illustrated is FIGS. 2A, 2B, 2D, and 2E. Although not illustrated in the drawings, a rear view of the contact 1 is symmetrical to the front view.

The fixing portion 3 comprises a base portion 11, a pair of leg portions 13 and 13, and a pair of joining portions 15 and 15. The base portion 11 comprises a flat plate having a first surface 11A and a second surface 11B. The first surface 11A and the second surface 11B face in opposite directions from each other. The leg portions 13 and 13 curve from end portions of the base portion 11 and extend in the direction the second surface 11B faces (downward, in the present embodiment). The joining portions 15 and 15 curve from locations of the leg portions 13 on the sides of tire leg portions 13 opposite from the base portion 11, and extend in a direction that is parallel to the base portion 11 (the front-back direction, in the present embodiment).

The elastic contact piece 5 comprises a plate spring portion 21, a contact portion 23, and a restricting portion 25. The plate spring portion 21 is a portion that extends out from one end of the base portion 11 of the fixing portion 3, and extends out in a direction that forms an acute angle with the first surface 11A or the base portion 11. The contact portion 23 is provided in a location of the plate spring portion 21 on the opposite side from the base portion 11. In the present embodiment, the contact portion 23 is formed having two protruding portions 23A and 23A. The restricting portion 25 is a portion that extends out from the contact portion 23, extending toward the base portion 11, with a leading end portion 25A in the extension direction hooked onto the base portion 11.

The projecting tabs 7 and 7 project from the fixing portion 3 at locations on both sides of the elastic contact piece 5 (both sides in the front-back direction, in the present embodiment). The projecting tabs 7 and 7 are formed such that each projecting tab 7 is a flat plate having the same thickness as the thin plate. The projecting tabs 7 are arranged such that the thickness directions thereof are the same direction, its locations that have inner surfaces of the projecting tabs 7 facing each other.

Figure 3A:
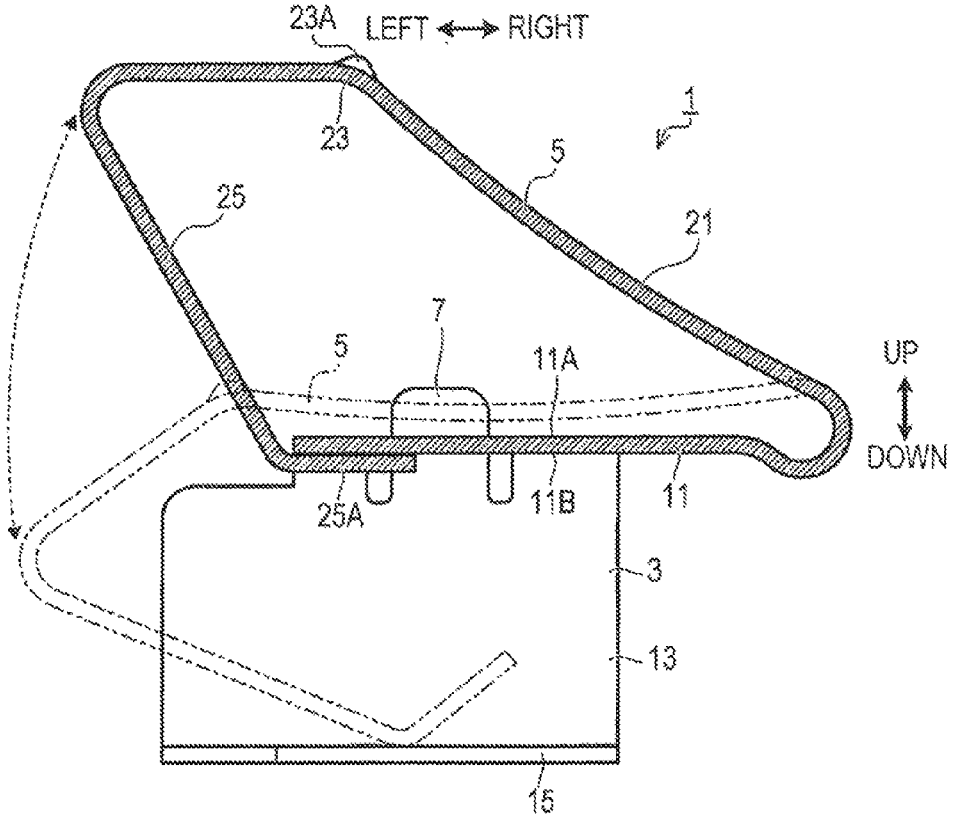
FIG. 3A is a cross-sectional view of a cut location indicated by line III-III in FIG. 2.
Figure 3B:
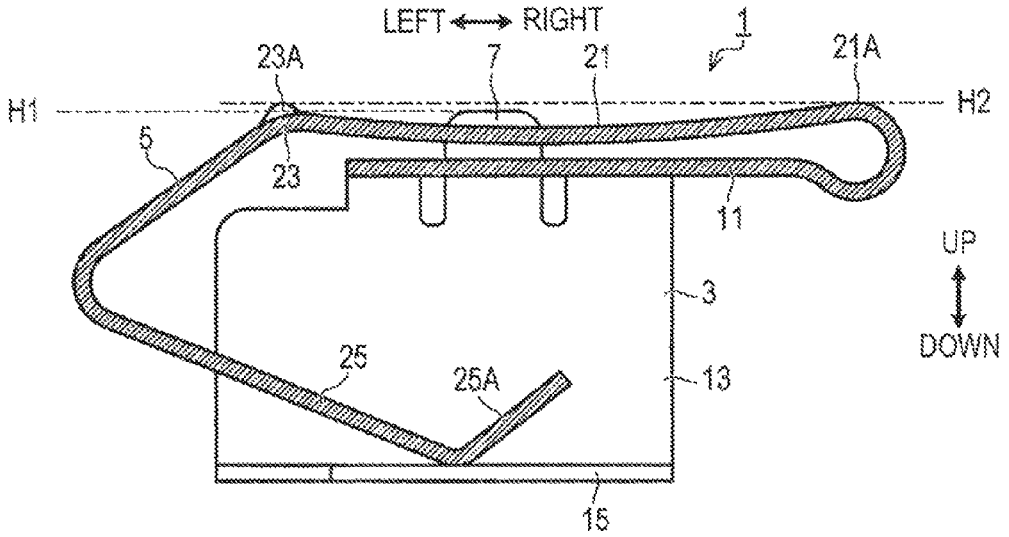
FIG. 3B is a cross-sectional view illustrating a state in which an elastic contact piece has swung to a second position.

In the contact 1 described above, the elastic contact piece 5 swings between a first position, which is illustrated in FIG. 3A, and a second position, which is illustrated in FIG. 3B. The second position is also indicated by a long dashed double-short dashed line in FIG. 3A. To be more specific, the elastic contact piece 5 stays in the first position as illustrated in FIG. 3A when in a state where no external force is acting on the elastic contact piece 5. As described above, the leading end portion 25A of the restricting portion 25 is hooked on the fixing portion 3 at this time. This restricts the contact portion 23 from displacing in a direction of displacement from the first position toward the second position).

When an external force in a direction that swings the elastic contact piece 5 from the first position, toward the second position acts on the elastic contact piece 5, mainly the plate spring portion 21 elastically deforms, which causes the elastic contact piece 5 to displace from the first position (see FIG. 3A) toward the second position (see FIG. 3B). On the other hand, when an external force stops acting on the elastic contact piece 5 while the elastic contact piece 5 is in the second position, the portion that had been elastically deformed is restored to its original shape, which returns the elastic contact piece 5 from the second position to the first position.

Figure 4B:
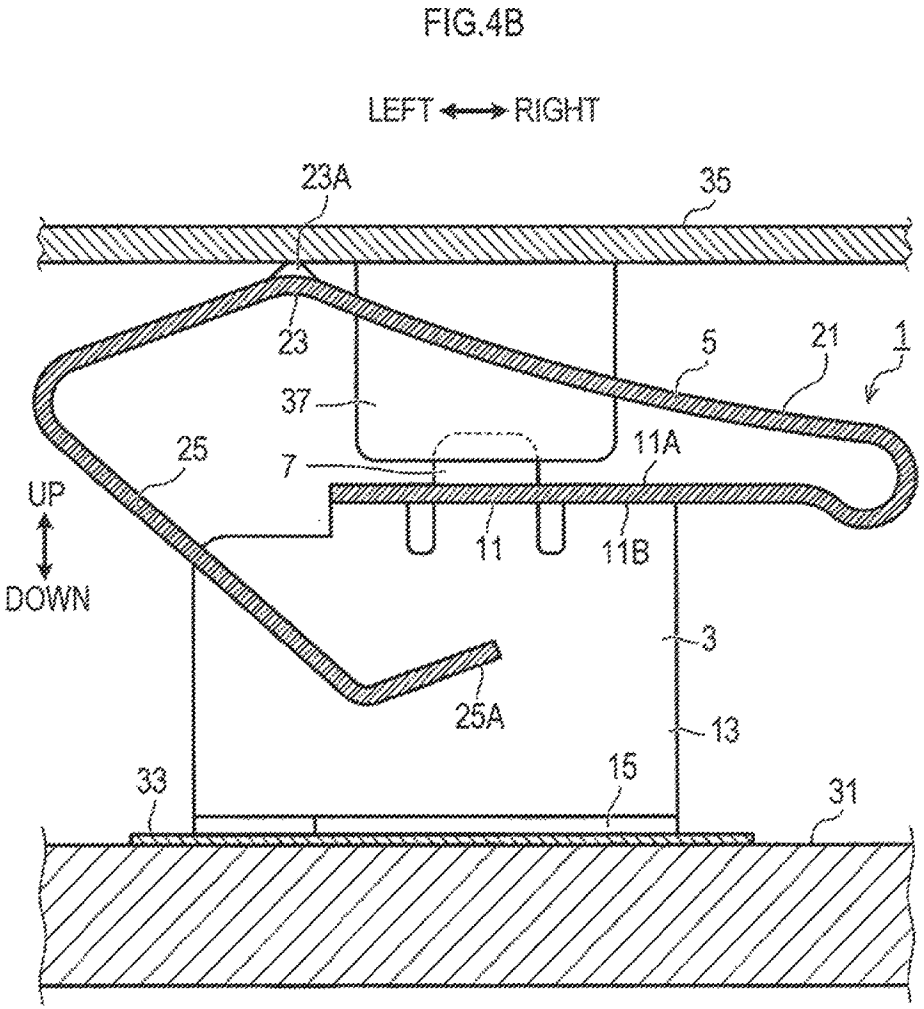
FIG. 4B is a cross-sectional view of a cut location indicated by line IVB-IVB in FIG. 4A.
Figure 4A:
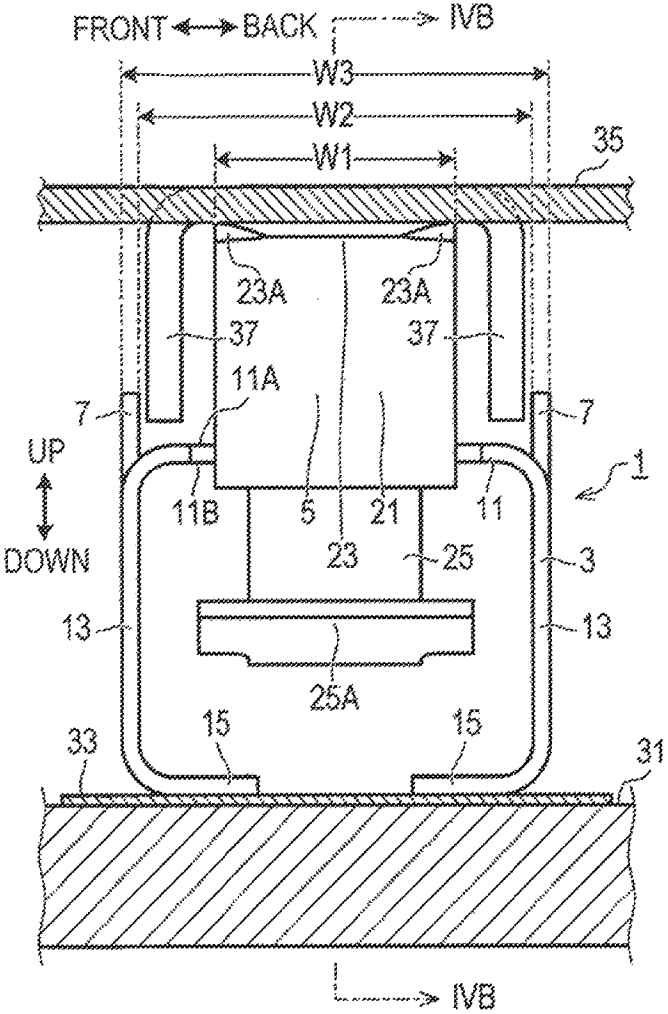
FIG. 4A is a schematic diagram illustrating a usage state (number 1) of the contact according to the first embodiment.

As illustrated in FIGS. 4A and 4B, the contact 1 configured in this manner is soldered to a conductor pattern 33 included in an electronic circuit board 31, and makes contact with a conductive member 35 aside from the electronic circuit board 31. The conductor pattern 33 and the conductive member 35 are electrically coupled or connected as a result. The above-described fixing portion 3 is a part that is fixed to the electronic circuit board 31. More specifically, the surfaces of the joining portions 15 and 15 facing in the same direction as the second surface 11B of the base portion 11 are used as joining surfaces that are soldered to the conductor pattern 33. Note that the joining surfaces may be plated (with gold or nickel, for example).

The above-described elastic contact piece 5 is a part that makes contact with the conductive member 35. When the conductive member 35 is positioned so as to face the electronic circuit board 31, the elastic contact piece 5 makes contact with the conductive member 35, elastically deforms, and is pressed against the conductive member 35. At this time, the two protruding portions 23A and 23A of the above-described contact portion 23 are in contact with the conductive member 35. The two protruding portions 23A and 23A making contact with the conductive member 35 in this manner makes it possible to bring the contact portion 23 into contact with the conductive member 35 at multiple points, which ensures more conductive paths than a contact portion that makes contact at a single point. Additionally, the contact pressure where this contact takes place can be increased as compared to a contact portion that makes contact over a broad surface. Thus in a situation in which a metal oxide layer is formed where this contact takes place, the layer can be worn away, which makes it possible to suppress a drop in conductivity. Note that the contact portion 23 too may be plated (with gold or nickel, for example).

The elastic contact piece 5 displaces to a position based on a gap formed between the electronic circuit board 31 and the conductive member 35. In the example illustrated m FIGS. 4A and 4B, the elastic contact piece 5 is displaced to a position between the first position and the second position. As illustrated in FIG. 3B, in the case where the elastic contact piece 5 has displaced to the second position, the protruding portions 23A of the contact portion 23 descend to a position H2, which with respect to a height direction (the up-down direction, in FIGS. 3A and 3B) is the same position as a connection portion 21A between the plate spring portion 21 and the fixing portion 3. The "height direction" referred to here is a direction perpendicular to a component mounting surface of the electronic circuit board 31 to which the fixing portion 3 is soldered (see FIGS. 4A and 4B). This position is higher the greater the distance from the component mounting surface is. Leading end portions of the projecting tabs 7 in the direction in which the tabs project are at a position H1, which is lower than the above-described position H2.

The relative positional relationship between the contact portion 23, the above-described connection portion 21A, and the leading end portions of the projecting tabs 7 in the direction in which the tabs project are in a positional relationship such as that described above. Thus, when the surface of the electronic circuit board 31 to which the fixing portion 3 is fixed and the surface of the conductive member 35 that makes contact with the protruding portions 23A of the contact portion 23 are arranged substantially parallel and those two surfaces are brought relatively closer to each other, the protruding portions 23A of the contact portion 23 make contact with the conductive member 35 first.

When those surfaces are then brought even closer to each, other relatively the contact portion 23 displaces, which brings both the connection portion 21A between the plate spring portion 21 and the fixing portion 3, and the protruding portions 23A of the contact portion 23, into contact with the conductive member 35 (the state illustrated in FIG. 3B). At this point in time, the plate spring portion 21, between the connection portion 21A and the contact portion 23, is not in contact with the conductive member 35 (in other words, the plate spring portion 21 forms a concave surface, as indicated in the upper part of FIG. 3B, and a gap is present between that concave surface and the conductive member 35). Furthermore, the leading end portions of the projecting tabs 7 in the direction in which the tabs project are not in contact with the conductive member 35.

When the two surfaces are then brought even closer to each other relatively, the leading end portions of the projecting tabs 7 in the direction in which the tabs project make contact with the conductive member 35. As a result, the projecting tabs 7 function as stoppers and suppress a situation in which the plate spring portion 21 is excessively compressed. In this manner, the projecting tabs 7 make contact with the conductive member 35 immediately after the above-described connection portion 21A makes contact with the conductive member 35. Thus the projecting tabs 7 can be caused to function as stoppers after the elastic deformation capabilities of the plate spring portion 21 are pushed to the maximum limit.

Additionally, in the contact 1, a dimension of the elastic contact piece 5 in a width direction, which corresponds to the direction of the interval between the projecting tabs 7 and 7 (the front-back direction, in the present embodiment), is a first dimension W1, as illustrated in FIG. 4A. An interval between the inner surfaces of the projecting tabs 7 and 7 is a second dimension W2, which is greater than the first dimension W1. Furthermore, a dimension of the fixing portion 3 in the width direction, which matches the direction of the interval between the projecting tabs 7 and 7, is a third dimension W3, which is greater than the second dimension W2. A distance between outer surfaces of the projecting tabs 7 and 7, which face in opposite directions from each other, corresponds to the third dimension W3. In other words, a front surface of the fixing portion 3 is flush with one outer surface (a front surface) of each projecting tab 7, and a rear surface of the fixing portion 3 is flush with the other outer surface (a rear surface) of each projecting tab 7.

Effects

According to the contact 1 configured as described above, the conductor pattern 33 of the electronic circuit board 31 can be electrically coupled or connected to the conductive member 35, which is separate from the electronic circuit board 31. Additionally, in this contact 1, each projecting tab 7 is only as thick, with respect to the direction of the interval between the projecting tabs 7 (the front-back, direction, in the present embodiment), as the single thin plate described above. Thus, a region occupied by the projecting tabs 7 and 7 can be made compact with respect to the direction of the interval described above. Accordingly, the overall structure of the contact 1 can be made more compact, improving the ability to incorporate the contact into small devices, than its a case where projecting portions that are thicker than the above-described thin plate (a structure such as that described in '035 Publication, for example) are provided.

Furthermore, if the above-described elastic contact piece 5 and projecting tabs 7 and 7 are used, providing positioning tabs 37 and 37 in the conductive member 35 as illustrated in FIGS. 4A and 4B makes it possible to position the conductive member 35 and the contact 1 with respect to each other. Each positioning tab 37 has a cross-sectional shape, orthogonal to the thickness direction of the conductive member 35, that forms a through-hole, with a shape corresponding to three sides of a square, such that the remaining side forms a cantilevered tongue piece serving as a fixed end. The tongue piece is best downward at 90 degrees neat the fixed end.

These positioning tabs 37 and 37 are arranged on both sides of the elastic contact piece 5 (both sides in the front-back direction), with the projecting tabs 7 and 7 in turn being located on both sides of the pair of positioning tabs 37 and 37. Employing this configuration makes it possible to ensure that the positioning tabs 37 and 37 make contact with the projecting tabs 7 and 7 but do not make contact with the elastic contact piece 5.

In other words, when the conductive number has displaced rearward relative to the electronic circuit board 31, the positioning tab 37 located further forward than the elastic contact piece 5 approaches the elastic contact piece 5. However, in this case, before the positioning tab 37 located further forward than the elastic contact piece 5 makes contact with the elastic contact piece 5, the positioning tab 37 located further rearward than the elastic contact piece makes contact with the projecting tab 7 located further rearward than the elastic contact piece 5. This restricts the conductive member 35 from displacing any further rearward.

Likewise, when the conductive member 35 has displaced forward relative to the electronic circuit board 31, the positioning tab 37 located further rearward than the elastic contact piece 5 approaches the elastic contact piece 5. However, in this case, before the positioning tab 37 located further rearward than the elastic contact piece 5 makes contact with the elastic contact piece 5, the positioning tab 37 located further forward than the elastic contact piece 5 makes contact with the projecting tab 7 located further forward than the elastic contact piece 5. This restricts the conductive member 35 from displacing any further forward.

In other words, the pair of projecting tabs 7 and 7 suppress a situation in which the positioning tabs 37 and 37 make contact with the elastic contact piece 5. Thus providing the projecting tabs 7 and makes it possible to suppress a situation in which the elastic contact piece 5 bends due to contact between the positioning tabs 37 and 37 and the elastic contact piece 5. This makes it possible to ensure that the elastic contact piece 5 functions as designed.

Providing the positioning tabs 37 means that a through-hole is formed in the conductive member 35, passing through the conductive member 35 in the thickness direction thereof, which makes it possible to see the contact 1 through the through-hole. Whether or not the contact 1 and the conductive member 35 are in contact can thus be confirmed after arranging the conductive member 35.

Additionally, with the contact 1 according to the present embodiment, the width of the fixing portion 3 and the distance between the outer surfaces of the projecting tabs 7 and 7 are both the third dimension W3. This means that the projecting tabs 7 and 7 are provided at positions utilizing the width of the fixing portion 3 to the maximum extent. Thus the fixing portion 3 can be made compact in the width direction while ensuring the maximum interval between the projecting tabs 7 and 7.

Additionally, with the contact 1 according to the present embodiment, the fixing portion 3 comprises the joining portions 15 and 15 described above. Thus, the contact 1 can be coupled or connected to the conductor pattern 33 at multiple points. This makes it possible to secure an equivalent number of conductive paths, which in turn makes it possible to reduce the impedance of the contact 1.

Additionally, with the contact 1 according to the present embodiment, the elastic contact piece 5 comprises the restricting portion 25 described above. Thus, the contact portion 23 can be restricted from excessive displacement away from the fixing portion 3. This makes it possible to suppress a situation in which the plate spring portion 21 experiences plastic deformation due to the contact portion 23 displacing excessively away from the fixing portion 3, which in turn makes it possible to suppress a situation in which the plate spring portion 21 loses its functionality.

Variation

The conductive member 35 illustrated in FIGS. 4A and 4B is configured such that the positioning tabs 37 and 37 are arranged on both sides of the elastic contact piece 5, with the projecting tabs 7 and 7 in turn being located on both sides of the pair of positioning tabs 37 and 37. However, the specific shape of the conductive member is not limited to the example described above. For example, as indicated by a conductive member 38 illustrated in FIGS. 5A and 5B, the configuration may be such that positioning tabs 39 and 39 are arranged on both skies of the pair of projecting tabs 7 and 7. Even when using the conductive member 38, the projecting tabs 7 and 7 can suppress a situation in which the positioning tabs 39 and 39 make contact with the elastic contact piece 5.

Figure 5B:
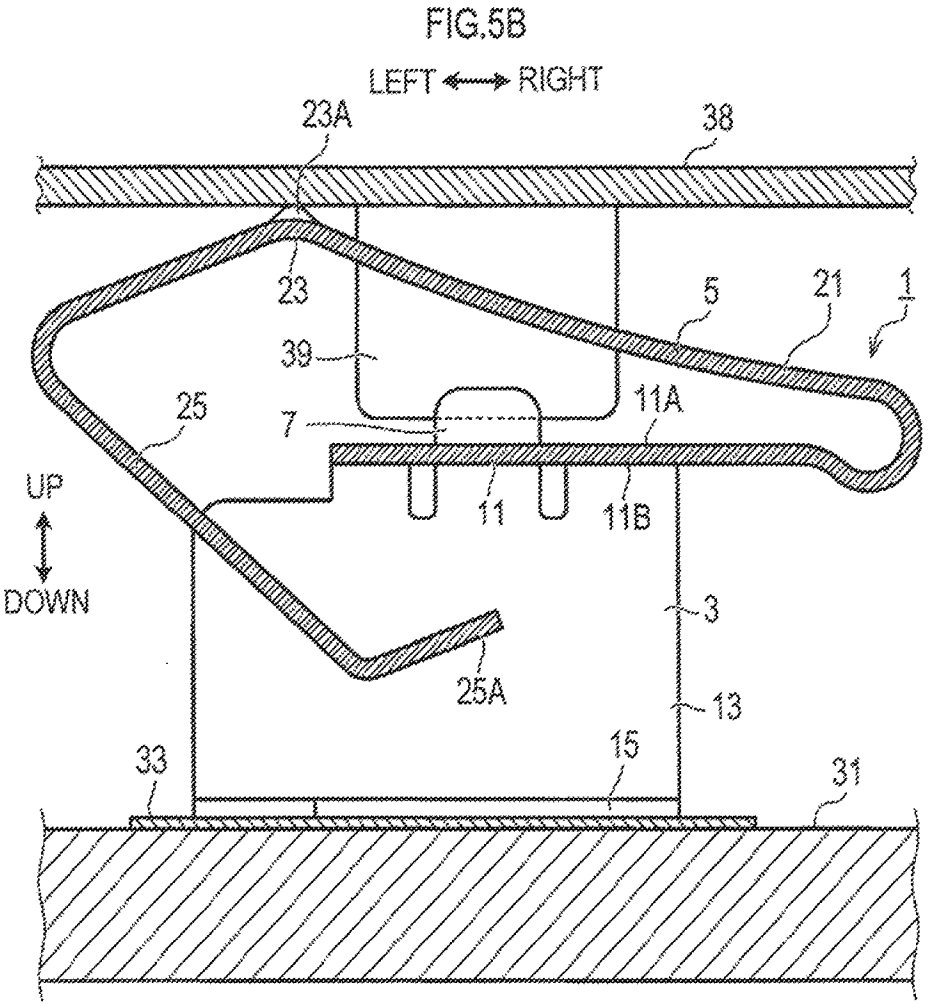
FIG. 5B is a cross-sectional view of a cut location indicated by line VB-VB in FIG. 4.
Figure 5A:
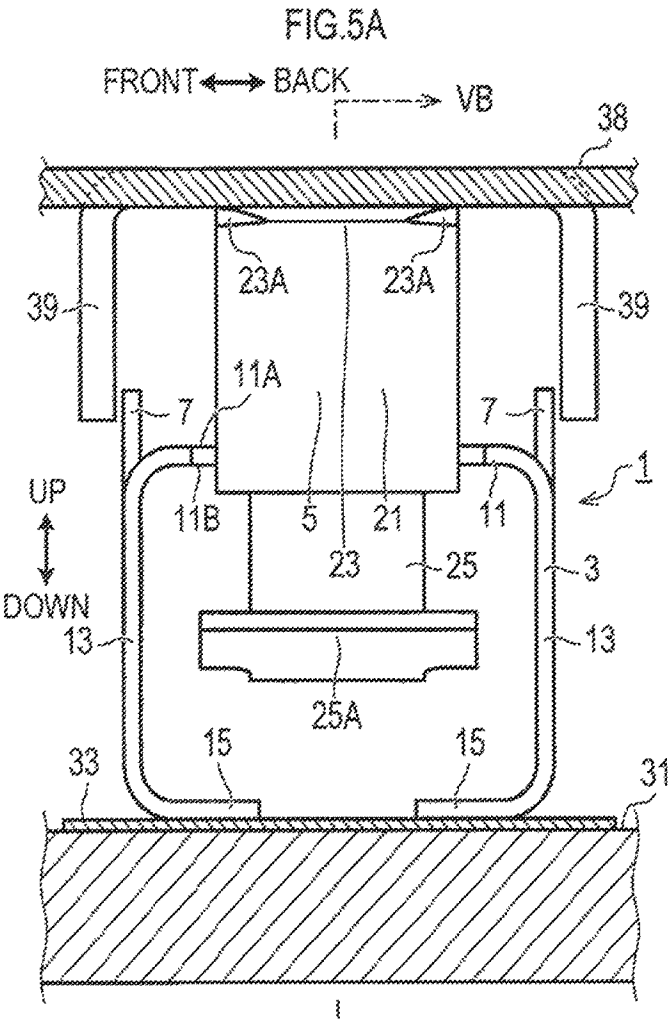
FIG. 5A is a schematic diagram illustrating a usage state (number 2) of the contact according to the first embodiment.

With the conductive member 35 illustrated in FIGS. 4A and 4B and the conductive member 38 illustrated in FIGS. 5 and 5B, the positioning tabs 37 and 37 and the positioning tabs 39 and 39 are shaped so as to extend straight downward. However, as indicated by a conductive member 40 illustrated in FIG. 6A, positioning tabs 41 and 41 may be provided with angled portions 41A in the leading ends thereof. In this case, the positioning tabs 41 and 41 can easily be inserted between the projecting tabs 7 and 7 by using the angled portions 41A of the positioning tabs 41.

(2) Second Embodiment

A second embodiment will be described next. Note that the second and subsequent embodiments are partial modifications of the configuration described as an example in the first embodiment, and thus, mainly the differences from the first embodiment will be described in detail. Parts identical to those in the first embodiment will be given the same reference numerals, and detailed descriptions thereof will be omitted.

Figure 6B:
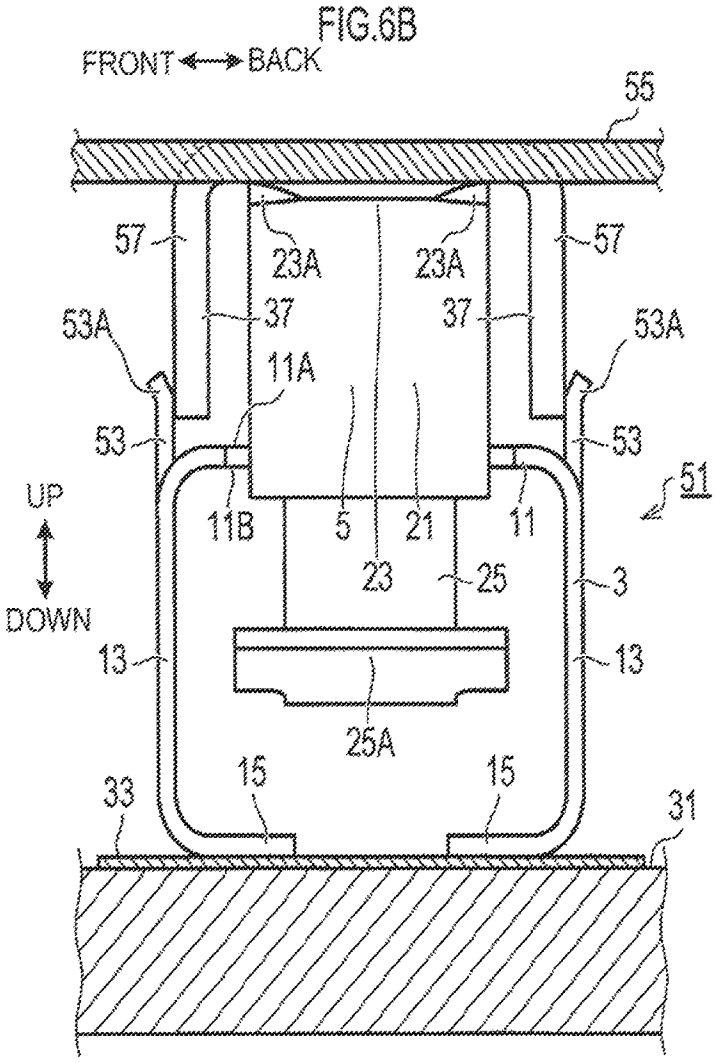
FIG. 6B is a schematic diagram illustrating a contact according to a second embodiment.
Figure 6A:
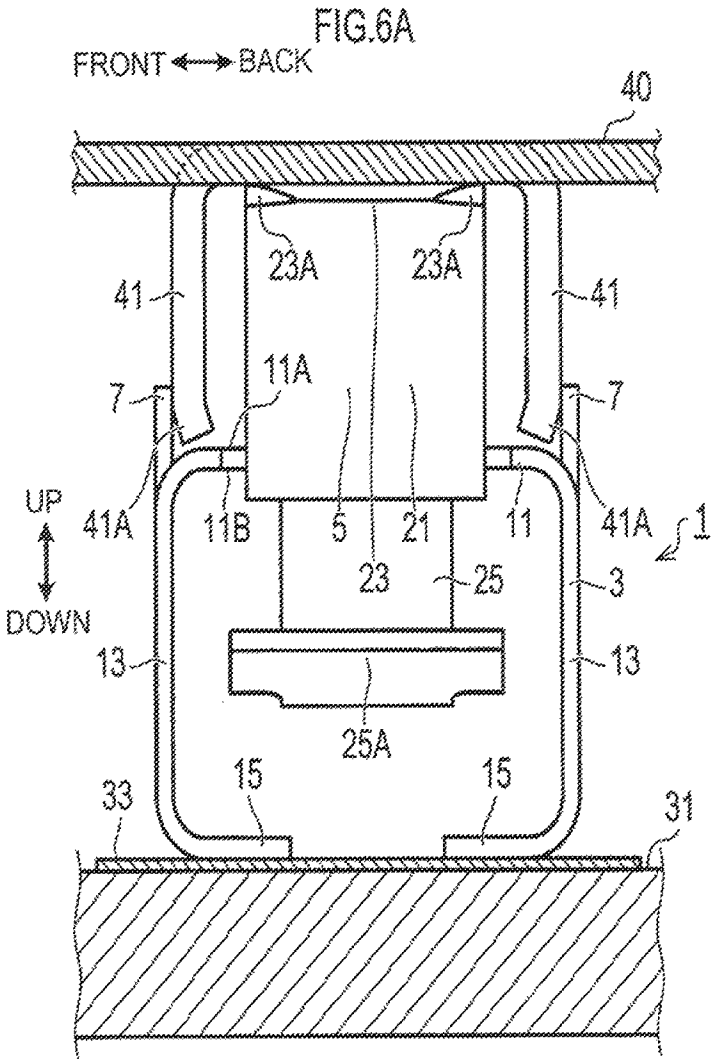
FIG. 6A is a schematic diagram illustrating a usage state (number 3) of the contact according to the first embodiment.

In the first embodiment, with the example illustrated in FIG. 6A, the angled portions 41A are provided is the leading ends of the positioning tabs 41 and 41 of the conductive member 40. However, angled portions having the same effect can be provided on the contact side as well. For example, as indicated by a contact 51 illustrated is FIG. 6B, angled portions 53A and 53A may be provided in leading ends of projecting tabs 53 and 53. Even when employing such a configuration, a pair of positioning tabs 57 and 57 of a conductive member 35 can easily be inserted between the projecting tabs 53 and 53 by using the angled portions 53A of the projecting tabs 53. It is also possible to use both the angled portions 41A and 41A described is the first embodiment with reference to FIG. 6A and the angled portions 53A and 53A described in the second embodiment with reference to FIG. 6B in combination with each other.

(3) Third Embodiment

A third embodiment will be described next.

Figure 7B:
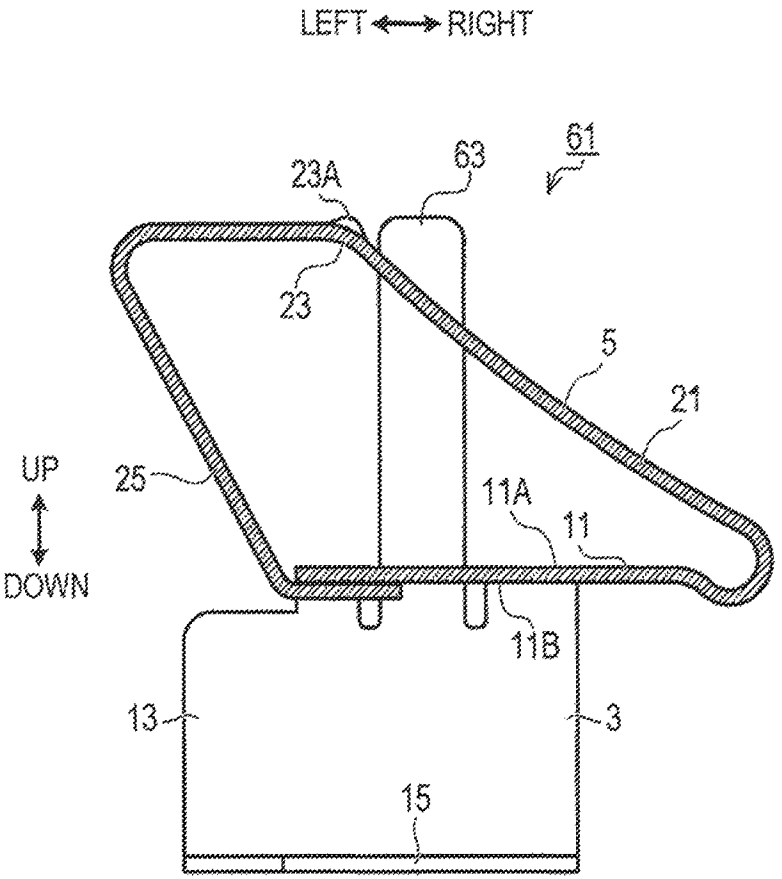
FIG. 7B is a cross-sectional view of a cut location indicated by line VIIB-VIIB in FIG. 7A.
Figure 7A:
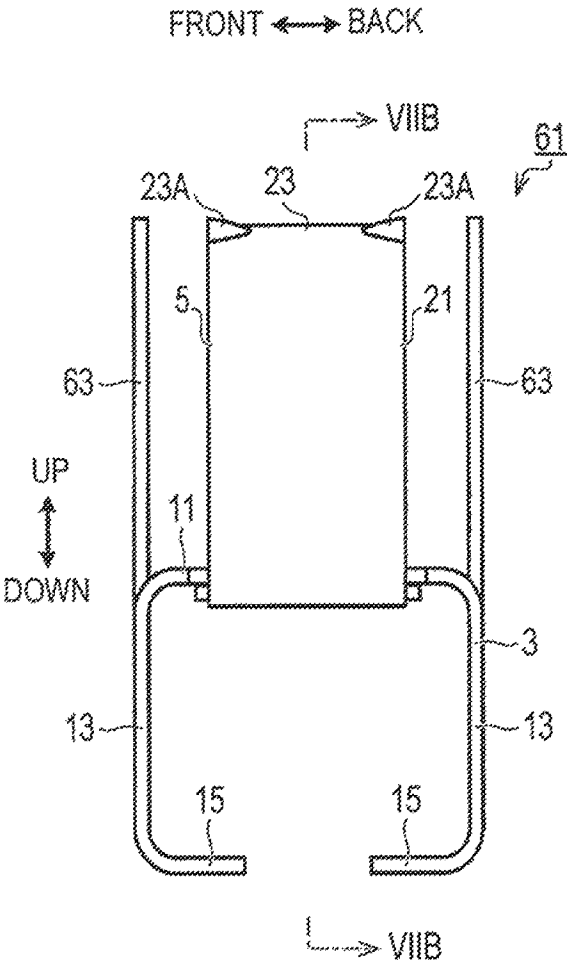
FIG. 7A is a schematic diagram illustrating a state in which, in a contact according to a third embodiment, a conductive member is not in contact with an elastic contact piece.

As illustrated in FIGS. 7A and 78, with a contact 61 according to the third embodiment, projecting tabs 63 and 63 project by a greater amount than the projecting tabs described in the first and second embodiments. Specifically, when the elastic contact piece 5 is in the first position, upper ends of the projecting tabs 63 and 63 are at the same height as the protruding portions 23A and 23A of the contact portion 23.

Figure 8B:
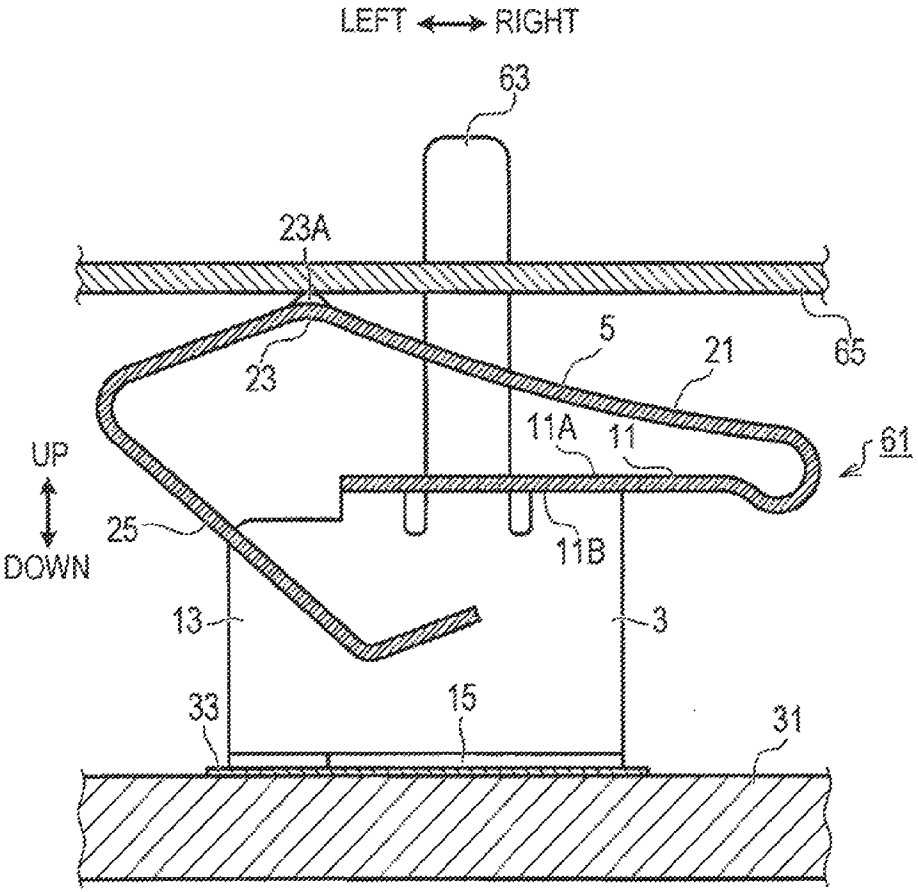
FIG. 8B is a cross-sectional view of a cut location indicated by line VIIIB-VIIIB in FIG. 8A.
Figure 8A:
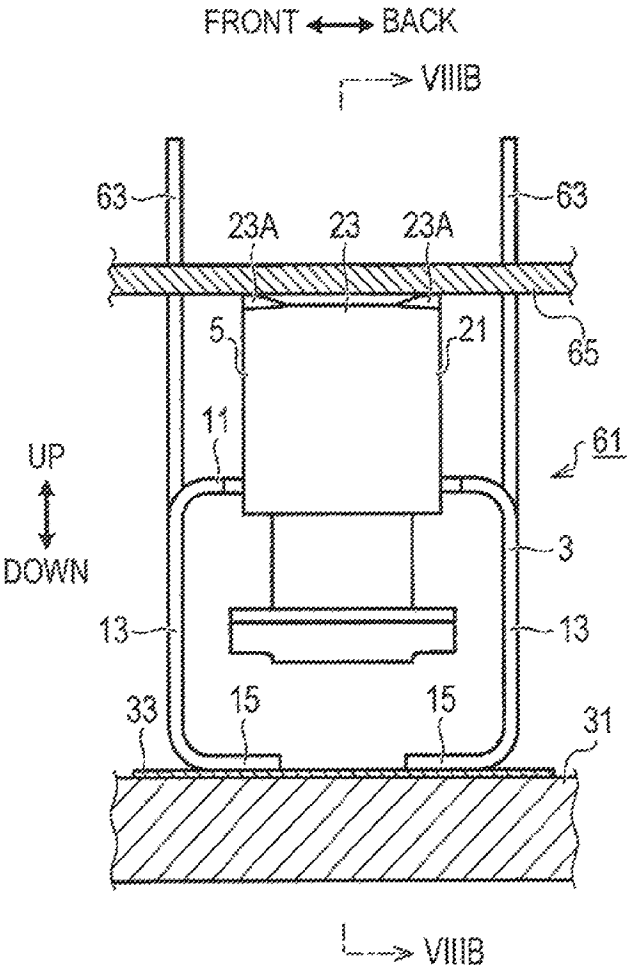
FIG. 8A is a schematic diagram illustrating a state in which, in the contact according to the third embodiment, the conductive member is in contact with the elastic contact piece.
Figure 9A:
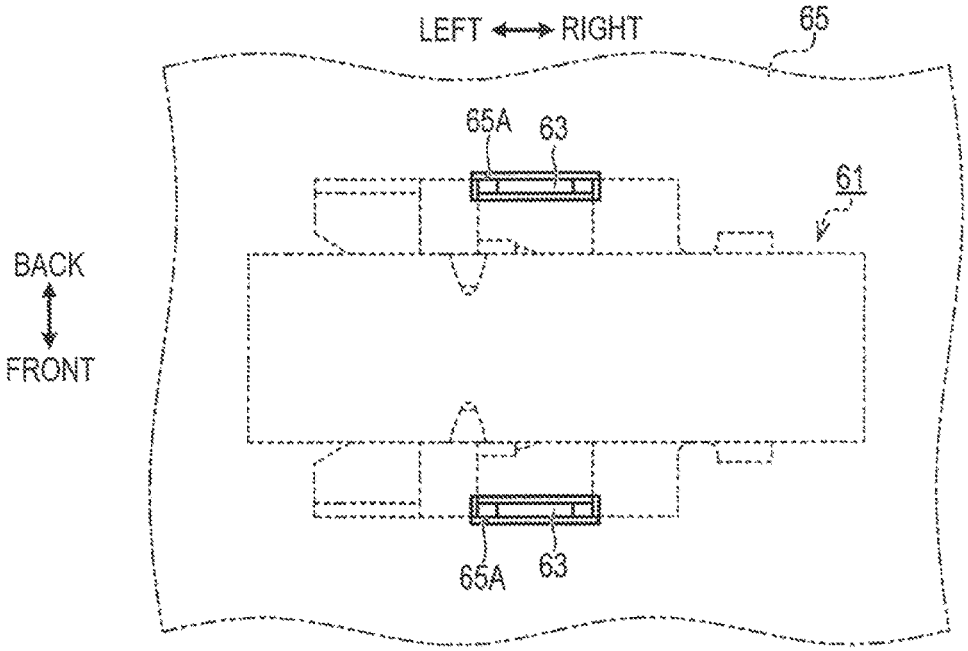
FIG. 9A is a schematic diagram illustrating a structure of the conductive member (number 1) that makes contact with the contact according to the third embodiment.

As illustrated in FIGS. 8A and 8B, the contact 61 configured in this manner is soldered to the same type of electronic circuit board 31 as that described in the first embodiment, and a conductive member 65 is arranged in a position that makes contact with the contact 61. However, in the third embodiment, the conductive member 65 has a different shape from the conductive member 35 of the first embodiment and the like. More specifically, the conductive member 65 has a pair of through-holes 65A and 65A, as illustrated in FIG. 9A. The through-holes 65A and 65A are formed in consideration of the positions and sixes of the projecting tabs 63 and 63 of the contact 61, at positions and sixes that enable the projecting tabs 63 and 63 to fit perfectly into the corresponding through-holes 65A and 65A.

Thus, when the conductive member 65 is arranged in a position such as that illustrated in FIGS. 8A and 8B, the projecting tabs 63 and 63 pass through the corresponding through-holes 65A, and the leading end portions of the projecting tabs 63 in the direction in which the tabs project protrude from one surface of the conductive member 65 (the top surface, in FIGS. 8A and 8B). Using the contact 61 makes it possible to position the conductive member 65 and the contact 61 with respect to each other by inserting the projecting tabs 63 into the through-holes 65A when bringing the elastic contact piece 5 and the conductive member 65 into contact with each, other.

Figure 9B:
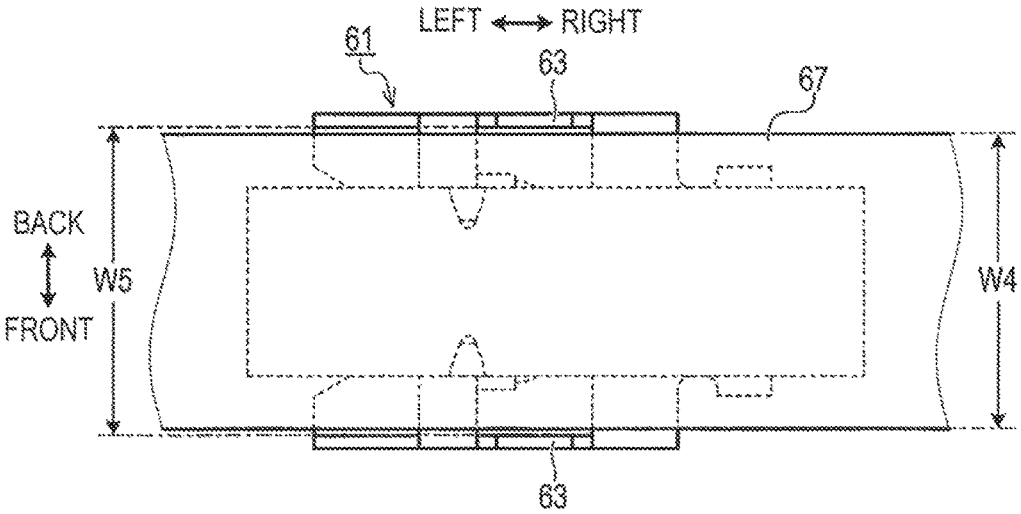
FIG. 9B is a schematic diagram illustrating a structure of the conductive member (number 2) that makes contact with the contact according to the third embodiment.

The contact 61 according to the third embodiment can also be brought into contact with a conductive member having a different shape from the conductive member 65 having the through-holes 65A as described above. To give a specific example, a band-shaped conductive member 67 can also be used, as illustrated in FIG. 9B. In this case, a constituent element equivalent to the through-holes 65A need not be provided. To be more specific, with the conductive member 67 illustrated in FIG. 9B, a width direction dimension W4 thereof is smaller than an interval W5 between the projecting tabs 63 and 63 (that is, W4<W5). The conductive member 67 can therefore be arranged between the projecting tabs 63 and 63, which makes it possible to position the conductive member 67 and the contact 61 with respect to each other. Forming a band-shaped portion by machining part of a larger conductive member, joining a band-shaped conductive member to a separate conductive member, and the like can be considered as implementations of the stated band-shaped conductive member 67. Alternatively, in the case where a metal terminal of as electronic component is formed in a hand shape, the metal terminal may act as an equivalent of the conductive member 67 and be brought into contact with the contact 61.

(4) Other Embodiments

The contacts 1, 51, and 61 described above are example embodiments, and are nothing more than embodiments of the present disclosure. In other words, the present disclosure is not limited to the example embodiments described above and can be embodied in various forms.

For example, two or more of the configurations employed in the above-described embodiments may be combined and used in such a form. Additionally, a predetermined function realized by a single constituent element in the above-described embodiments may instead be realized by a plurality of constituent elements working in tandem. Alternatively, a plurality of functions provided by a corresponding plurality of constituent elements, or a predetermined function realized by a plurality of constituent elements working in tandem, may be realized by a single constituent element. Parts of the configurations in the above-described embodiments may be omitted. At least part of the configuration of one of the above-described embodiments may be added to or replace the configuration of another of the above-described embodiments. Note that all embodiments encompassed within the technical spirit defined by the language of the appended, claims fall within the scope of the present disclosure.

(5) Supplemental Descriptions

Note that as is clear from the example embodiments described above, the contact according to the present disclosure may be further provided with configurations such as those given below.

First, in the contact according to the present disclosure, a dimension of the fixing portion in the width direction that matches the direction of the interval between the projecting tabs may be a third dimension greater than the second dimension; and a distance between outer surfaces of the projecting tabs, the outer surfaces facing in opposite directions from each other, may be the third dimension.

According to the contact configured in this manner, both the width of the fixing portion and the distance between the outer surfaces of the projecting tabs are the third dimension. Thus the projecting tabs are provided in positions utilizing the width of the fixing portion to the maximum extent, and as a result, the fixing portion can be made compact in the width direction while ensuring the maximum interval between the projecting tabs.

Additionally, in the contact according to the present disclosure, the fixing portion ay comprise: a base portion having a first surface and a second surface that face in opposite directions from each other; a pair of leg portions extending from the base portion in a direction in which the second surface faces; and a pair of joining portions each extending from the opposite side of a corresponding leg portion from the side of the leg portion in which the base portion is located, a surface of each joining portion facing in the same direction as the second surface being configured to be soldered to the conductive pattern.

According to the contact, configured in this manner, the fixing portion comprises a pair of joining portions as described above. Thus compared to a case where only a single joining portion is provided, the contact can couple or connect to the conductor pattern at multiple points. This makes it possible to secure an equivalent number of conductive paths, which in turn makes it possible to reduce the impedance of the contact.

Additionally; in the contact according to the present disclosure, the elastic contact piece may comprise: a plate spring portion extending from the fixing portion in a direction that forms an acute angle with the first surface; a contact portion provided in a location on the opposite side of the plate spring portion as the side on which the base portion is located, the contact portion being configured to make contact with the conductive member; and a restricting portion extending from the contact portion toward the fixing portion, the restricting portion being configured to restrict the contact portion from displacing away from the fixing portion by a leading end of the restricting portion in the extension direction thereof hooking onto the fixing portion.

According to the contact configured in this manner, the elastic contact piece comprises the restricting portion described above. Thus, the contact portion can be restricted from excessive displacement away from the fixing portion. This makes it possible to suppress a situation in which the plate spring portion experiences plastic deformation due to the contact portion displacing excessively away from the fixing portion, which in turn makes it possible to suppress a situation in which the plate spring portion loses its functionality.

Additionally, in the contact according to the present disclosure, when a surface of the electronic circuit board to which the fixing portion is fixed and a surface of the conductive member with which the contact portion makes contact are arranged substantially parallel and the two surfaces are brought relatively closer to each other, the contact portion may initially be in a state of contact with, the conductive member. When the two surfaces are brought further closer to each other relatively, the contact portion may displace and a connecting portion between the plate spring portion and the fixing portion, as well as the contact portion, may both make con tact with the conductive member, at which point in time the plate spring portion between the connecting portion and the contact portion is not in contact with the conductive member and leading end portions of the projecting tabs in the extension directions of the projecting tabs are not in contact with the conductive member. When the two surfaces are brought further closer to each other relatively, the leading end portions of the projecting tabs in the extension directions of the projecting labs may come into contact with the conductive member.

With, the contact configured in this manner, "substantially parallel" is a concept spanning from being parallel in the strict sense of the word (that is, a state of an extremely high degree of parallelism) to a state that is not parallel in the strict sense of the word but can be considered substantially parallel (a state of less parallelism than "parallel" in the strict sense of the word, such as a state in which one surface is tilted relative to another surface within a range of approximately ±5 degrees or within a margin of error).

According to the contact configured in this manner, the relative positional relationship between the above-described contact portion, the above-described connecting portion, and the leading end portions of the projecting tabs in the direction in which the tabs project, is positional relationship in which those elements make connect with the conductive member in the above-described order when the above-described two surfaces are brought relatively closer to each other. Thus, if the conductive member is brought toward the electronic circuit board after already pushing the elastic deformation capabilities of the plate spring portion to the maximum limit, the projecting tabs can be caused to function as stoppers.

What is claimed is:

1. A contact that, by being soldered to a conductive pattern in an electronic circuit board so as to make contact with a conductive member separate from the electronic circuit board, electrically connects or couples the conductive pattern to the conductive member, the contact comprising:

a fixing portion configured to be fixed to the electronic circuit board by the soldering;

an elastic contact piece extending from the fixing portion, the elastic contact piece being configured to be capable of swinging relative to the fixing portion by elastically deforming, the elastic contact piece being further configured to contact the conductive member and elastically deform so as to be pressed by the conductive member when the conductive member is arranged in a position opposite from the electronic circuit board, and the elastic contact piece comprising protruding portions that bring the elastic contact piece into contact with the conductive member at multiple points; and a pair of projecting tabs projecting from the fixing portion at positions on both sides of the elastic contact piece, wherein the fixing portion, the elastic contact piece, and the pair of projecting tabs are formed as an integrated entity from a metal thin plate;

a dimension of the elastic contact piece in a width direction, the width direction matching a direction of an interval between the projecting tabs, is a first dimension, and the elastic contact piece is configured to be capable of swinging in a direction orthogonal to the width direction; and each projecting tab is configured as a flat plate having a same thickness as the thin plate, the projecting tabs are arranged substantially parallel to each other, with an interval between inner surfaces of the projecting tabs being a second dimension greater than the first dimension.

2. The contact according to claim 1, wherein an outer width dimension of the fixing portion in a direction that matches the direction of the interval between the projecting tabs is a third dimension greater than the second dimension; and a distance between outer surfaces of the projecting tabs, the outer surfaces facing in opposite directions from each other, is the third dimension.

3. The contact according to claim 1, wherein the fixing portion comprises:

a base portion having a first surface and a second surface that face in opposite directions from each other;

a pair of leg portions extending from the base portion in a direction in which the second surface faces; and a pair of joining portions each extending from the opposite side of a corresponding leg portion from the side of the leg portion in which the base portion is located, a surface of each joining portion facing in the same direction as the second surface being configured to be soldered to the conductive pattern.

4. The contact according to claim 3, wherein the elastic contact piece comprises:

a plate spring portion extending from the fixing portion in a direction that forms an acute angle with the first surface;

a contact portion provided in a location on the opposite side of the plate spring portion as the side on which the base portion is located, the contact portion being configured to make contact with the conductive member; and a restricting portion extending from the contact portion toward the fixing portion, the restricting portion being configured to restrict the contact portion from displacing away from the fixing portion by a leading end of the restricting portion in an extension direction hooking onto the fixing portion, the extension direction matching a direction in which the restricting portion extends.

5. The contact according to claim 4, wherein:

when a surface of the electronic circuit board to which the fixing portion is fixed and a surface of the conductive member with which the contact portion makes contact are arranged substantially parallel and the two surfaces are brought relatively closer to each other, the contact portion is initially in a state of contact with the conductive member;

when the two surfaces are brought further closer to each other relatively, the contact portion displaces and a connecting portion between the plate spring portion and the fixing portion, as well as the contact portion, both make contact with the conductive member, at which point in time the plate spring portion between the connecting portion and the contact portion is not in contact with the conductive member and leading end portions of the projecting tabs are not in contact with the conductive member; and when the two surfaces are brought further closer to each other relatively, the leading end portions of the projecting tabs come into contact with the conductive member.

6. The contact according to claim 2, wherein the fixing portion comprises:

a base portion having a first surface and a second surface that face in opposite directions from each other;

a pair of leg portions extending from the base portion in a direction in which the second surface faces; and a pair of joining portions each extending from the opposite side of a corresponding leg portion from the side of the leg portion in which the base portion is located, a surface of each joining portion facing in the same direction as the second surface being configured to be soldered to the conductive pattern.

7. The contact according to claim 6, wherein the elastic contact piece comprises:

a plate spring portion extending from the fixing portion in a direction that forms an acute angle with the first surface;

a contact portion provided in a location on the opposite side of the plate spring portion as the side on which the base portion is located, the contact portion being configured to make contact with the conductive member; and a restricting portion extending from the contact portion toward the fixing portion, the restricting portion being configured to restrict the contact portion from displacing away from the fixing portion by a leading end of the restricting portion in an extension direction hooking onto the fixing portion, the extension direction matching a direction in which the restricting portion extends.

8. The contact according to claim 7, wherein:

when a surface of the electronic circuit board to which the fixing portion is fixed and a surface of the conductive member with which the contact portion makes contact are arranged substantially parallel and the two surfaces are brought relatively closer to each other, the contact portion is initially in a state of contact with the conductive member;

when the two surfaces are brought further closer to each other relatively, the contact portion displaces and a connecting portion between the plate spring portion and the fixing portion, as well as the contact portion, both make contact with the conductive member, at which point in time the plate spring portion between the connecting portion and the contact portion is not in contact with the conductive member and leading end portions of the projecting tabs are not in contact with the conductive member; and when the two surfaces are brought further closer to each other relatively, the leading end portions of the projecting tabs come into contact with the conductive member.

* * * * *